United States Patent [19]

Eichost

[11] Patent Number: 4,969,069

[45] Date of Patent: Nov. 6, 1990

[54] COMBINATION EAR COVERING AND LIGHTING APPARATUS

[76] Inventor: Edwin J. Eichost, 14300 176th SE., Apt. M-9, Renton, Wash. 98058

[21] Appl. No.: 461,317

[22] Filed: Jan. 5, 1990

[51] Int. Cl.[5] ..... F21L 15/14

[52] U.S. Cl. ..... 362/105; 362/234; 362/253; D26/38; D26/39

[58] Field of Search ..... 362/103, 105, 106, 234, 362/253; 2/209.2, 423, 209.1, 209; D29/19; D26/38, 39

[56] References Cited

U.S. PATENT DOCUMENTS

| | | | |
|---|---|---|---|
| 3,309,691 | 3/1967 | Bonanno | 362/106 X |
| 4,195,328 | 3/1980 | Harris, Jr. | 362/106 X |
| 4,638,410 | 1/1987 | Barker | 362/106 X |

*Primary Examiner*—Stephen F. Husar

*Attorney, Agent, or Firm*—Robert W. Jenny

[57] ABSTRACT

Lights are incorporated in or attached to ear covering apparatus, such as ear muffs and earphones, and directed to illuminate a work area in front of the wearer of the apparatus. The lights are positioned low on the ear covering apparatus to avoid reflection of light into a wearer's eyes by eyeglasses.

4 Claims, 1 Drawing Sheet

COMBINATION EAR COVERING AND LIGHTING APPARATUS

BACKGROUND OF THE INVENTION

1 FIELD:

The subject invention is in the field of head mounted and head worn equipment, including ear muffs, head phones, microphones, spectacles, and apparatus for holding lights for illuminating a work area, as well as combinations of two or more of each item listed.

2 PRIOR ART:

The prior art includes a variety of ear muffs, headphones, headphone/microphone combinations, spectacles combined with lights and head mounted holders for lights along with the light. A sampling of the prior art, particularly related to head mounted lights and associated apparatus is shown in the following U.S. Pat. Nos.

| | |
|---|---|
| 3,249,271 | 4,462,064 |
| 3,634,676 | 4,631,645 |
| 3,665,451 | 4,718,126 |
| 4,797,793 | |

Under various circumstances of employment, it is necessary for workers to wear ear muffs to protect their ears from an overly noisy environment or to wear headphones for protection from the noise and for communication in spite of the noise. There are occasions when the work being done in such noisy environments is not adequately illuminated and it would be useful to be able to wear head mounted lights as well as the ear covering apparatus. None of the known head worn light apparatus is compatible enough with head worn ear covering apparatus to allow satisfactory wearing of both. Accordingly the prime objective of the subject invention is to provide head worn apparatus which combines ear covering apparatus and lighting apparatus for illuminating a work area. A secondary objective is that the apparatus be compact, i.e. free of projections which could bump or become engaged by objects in the work area in which the invention is used or otherwise interfere with the use of the invention.

SUMMARY OF THE INVENTION

The subject invention is the combination of ear covering apparatus, worn to protect and/or enhance the hearing of the wearer and lights for illuminating a work area adjacent to the wearer. The lighting apparatus in a preferred embodiment is built into the ear covering apparatus. In an alternate embodiment it is attached to the ear covering apparatus. Power for the light(s) may be provided by one or more dry cell batteries built into the apparatus, by batteries located remotely from the apparatus such as on a belt worn by the user or the power may be provided through an extension cord. In a preferred embodiment the switch for the light is mounted on one ear covering apparatus and the light is mounted in the other. The switch is inset so that operation by inadvertent contact with nearby objects is prevented. The light is faired into the ear covering apparatus to make the overall apparatus as compact as possible and minimize chances for snagging of the apparatus on objects in the work area.

The invention is described in more detail below with reference to the attached drawings.

DETAILED DESCRIPTION OF THE INVENTION

Figure 1:
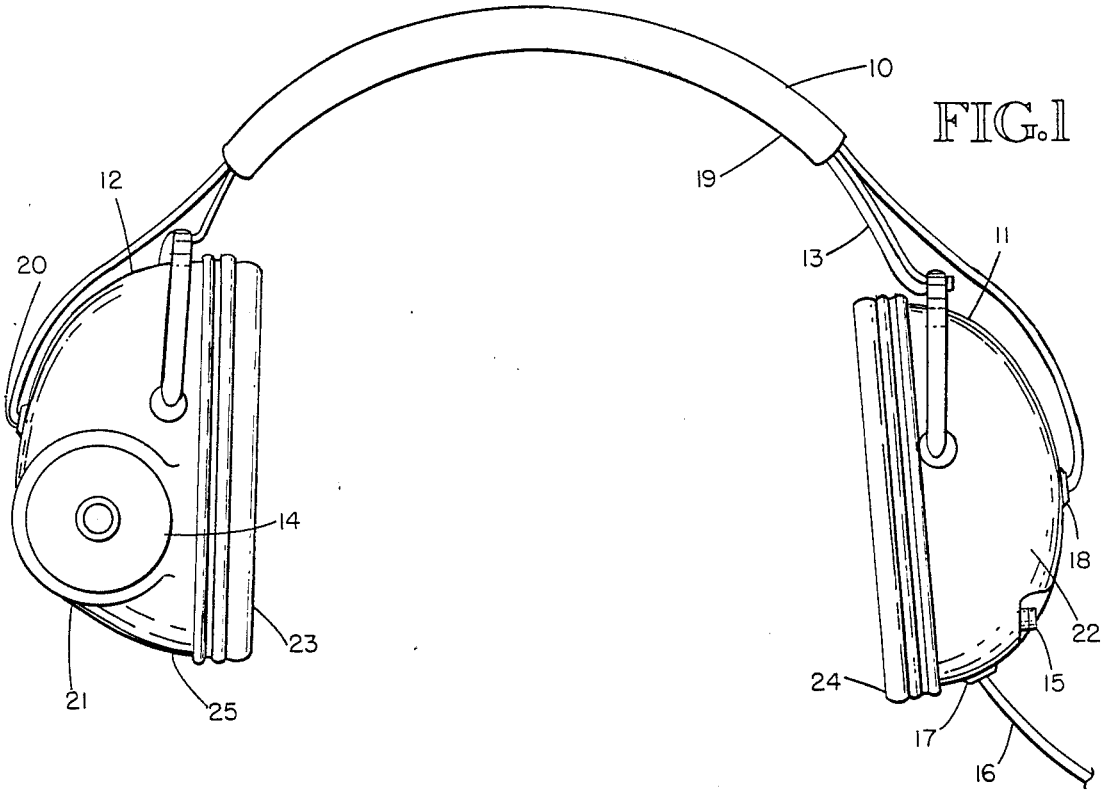
FIG. 1 is a perspective illustration of a set of ear muffs with a light built into one muff and the switch for the light built into the other.

The subject invention is a set of ear covering apparatus, such as ear muffs or ear phones, with a light fitted into at least one of the ear phones or ear muffs and directed to illuminate objects in view of a person wearing the ear covering apparatus. Power to the light(s) is controlled by a switch. In a preferred embodiment a light is incorporated into one ear covering and the switch into the other covering of the set. Such an embodiment is shown in FIG. 1. Ear muff set 10 comprises muff 11 and muff 12 interconnected by head band 13. Light 14 is incorporated into muff 11 and switch 15 is incorporated into muff 12. Power cord 16 enters muff 12 at 17, interconnects with the switch 15, exits muff 12 at 18 and is routed along headband 13 under padding sleeve 19 to enter muff 11 at 20 for connection to the socket of the light. The light comprises commercially available flashlight components: the bulb, lens, reflector and socket. The ear muffs comprise casings 21 and 22 and pads 23 and 24 and the pads are detachable from the casings so that worn pads can be replaced and to provide access into the casings for installation and servicing of the switch and light. The light is located near lower end 25 of the muff to reduce chances of the light beam being reflected into the eyes of users wearing eyeglasses.

Figure 2:
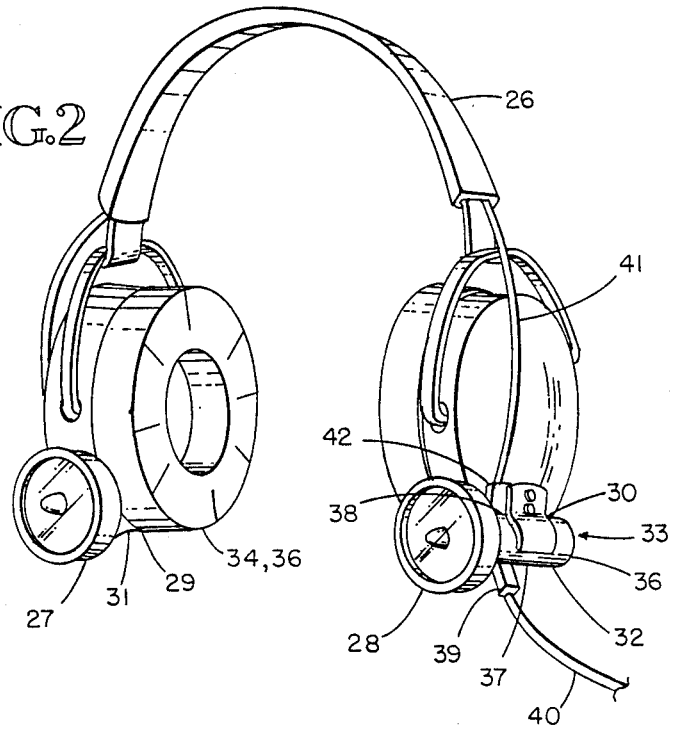
FIG. 2 is a perspective illustration of a set of ear muffs with a light attached to each muff with a switch built into each light.

FIG. 2 illustrates a set of ear muffs 26 with lights 27 and 28 attached to lower ends 29 and 30 respectively of the muffs. The lights are self contained assemblies including their cases 31 and 32 fitted with commercially available lenses, bulbs, reflectors and sockets. There are switches 33 and 34 inset in the back ends 35 and 36 of the cases and not visible in this view. There are two sockets in each light case, sockets 37 and 38 being visible in this view. Two-prong plug 39 on cable 40 provides power to light 27 directly and to light 28 via cable 41 with plugs at each of the ends, plug 42 being visible in this view. The lights are connected in series so that either one or both may be used.

Power is supplied from batteries carried by the user on a belt or the like or from any available electrical system outlet provided with a transformer, if necessary, to match the electrical system output voltage to the voltage of the lights.

It is considered to be clear from this description that the invention meets its objectives. It provides head worn apparatus which combines ear covering apparatus and lighting apparatus and the combined apparatus is compact and free of projections likely to bump or be engaged by objects in the work areas in which the invention is used.

It is also considered to be understandable that while preferred embodiments of the invention are described herein, other embodiments and modifications of those described are possible within the scope of the invention which is limited only by the attached claims.

I claim:

1. The combination, for use by a wearer facing a work area, of ear muffs and lights incorporated into said muffs for illuminating said work area.

2. The combination of claim 1 in which said ear covering apparatus comprises first and second muffs interconnected by a headband, said first and second muffs having lower ends with said lights positioned in said lower ends.

3. The combination of claim 1 in which said ear covering apparatus comprises first and second muffs interconnected by a headband, said first and second muffs having lower ends with said lights attached at said lower ends of at least one of said muffs.

4. The combination, for use by a wearer facing a work area, of ear muffs and lights attached to said muffs for illuminating said work area.

* * * * *